United States Patent [19]

Reid

[11] Patent Number: 4,796,806

[45] Date of Patent: Jan. 10, 1989

[54] BARBECUE SAUCE SPRAYER

[76] Inventor: Joyce P. Reid, 1316 W. 115th St., Chicago, Ill. 60643

[21] Appl. No.: 30,961

[22] Filed: Mar. 27, 1987

[51] Int. Cl.[4] ..... B05B 9/043

[52] U.S. Cl. ..... 239/11; 239/333; 99/516; 222/385

[58] Field of Search ..... 239/1, 11, 333, 596, 239/548; 222/321, 330, 383, 385; 99/516

[56] References Cited

U.S. PATENT DOCUMENTS

| | | | |
|---|---|---|---|
| 742,113 | 10/1903 | Castle | 222/385 |
| 1,817,293 | 8/1931 | Coffin | 222/385 |
| 2,136,263 | 11/1938 | Holmes | 222/321 |
| 2,519,640 | 8/1950 | Echols, Sr. et al. | 222/321 |
| 2,599,955 | 6/1952 | Toman | 239/333 |
| 2,630,944 | 3/1953 | Wheaton | 222/564 |
| 2,657,951 | 11/1953 | North, Jr. | 239/596 |
| 3,721,370 | 3/1973 | Blum | 222/385 |

*Primary Examiner*—Douglas C. Butler
*Assistant Examiner*—Karen B. Merritt
*Attorney, Agent, or Firm*—Alan R. Thiele

[57] ABSTRACT

A barbecue sauce sprayer includes a container, a pump for pumping barbecue sauce out of the container and a disc having a plurality of holes for causing the barbecue sauce to be discharged in a spray pattern.

5 Claims, 1 Drawing Sheet

BARBECUE SAUCE SPRAYER

BACKGROUND OF THE INVENTION

The present device relates to a method of spraying liquid. More particularly, the present invention relates to an apparatus and method which may be used for the spraying of barbecue sauce on food while it is being cooked over briquets or an open flame.

Barbecue cooking has become a pasttime of many families. Such cooking, while giving pleasure to many, also has its hazards and its drawbacks. Such hazards are caused when a viscous liquid such as barbecue sauce is used during the cooking process to flavor food. Typically, the cook utilizes a container to hold the barbecue sauce and a brush to paint barbecue sauce onto the food. Such practice is somewhat dangerous as the cook may be required to reach over very hot coals or an open flame in order to properly coat the food with barbecue sauce. The longer the time taken to brush the food with barbecue sauce the greater the chance for burning or injury to the cook.

The drawbacks associated with outdoor cooking relate to the cooking process itself. Despite careful efforts by the cook, a brush is often inadequate to completely and evenly apply the necessary amount of barbecue sauce. In such cases, cooks may pour barbecue sauce directly onto the food. This pouring technique oftentimes results in an excess of barbecue sauce in one area and an absence of sauce in another area of the food. Excess barbecue sauce may spill onto other food, may run over onto the grill itself or possibly fall into the flames. None of these results enhances the cooking process.

When the barbecue sauce runs over the side of the food and onto the grill it may burn onto the grill and form a hard and difficult to remove coating. When barbecue sauce falls into the flames it may cause a flare-up and injure the cook. When the barbecue sauce falls onto other food it may ruin its flavor.

There is therefore a need in the art to provide a method for dispensing barbecue sauce onto food while it is being barbecued which eliminates the need for brushing or pouring the barbecue sauce onto the food.

SUMMARY OF THE INVENTION

A sprayer for a viscous liquid such as barbecue sauce includes a container having an open end for the threadable mounting of a manual pump. The manual pump develops sufficient pumping force to pump the barbecue sauce from the container. After the barbecue sauce is pumped out of the container it passes through a fluid connection and is dispersed by a disc containing holes of a sufficient size to allow passage of the barbecue sauce. The combination of the pump force and the properly sized holes causes the barbecue sauce to be discharged in the form of a spray. This spraying of the barbecue sauce caused by forcing it through the holes in the disc permits barbecue sauce to be safely applied to food being cooked over a grill without having to suffer the discomfort of brushing barbecue sauce on the food or experiencing the inadequacies associated with pouring barbecue sauce on the food.

BRIEF DESCRIPTION OF THE DRAWING

A better understanding of the barbecue sauce spraying device of the present invention may be had by reference to the drawings wherein.

DETAILED DESCRIPTION OF THE EMBODIMENTS

Figure 1:
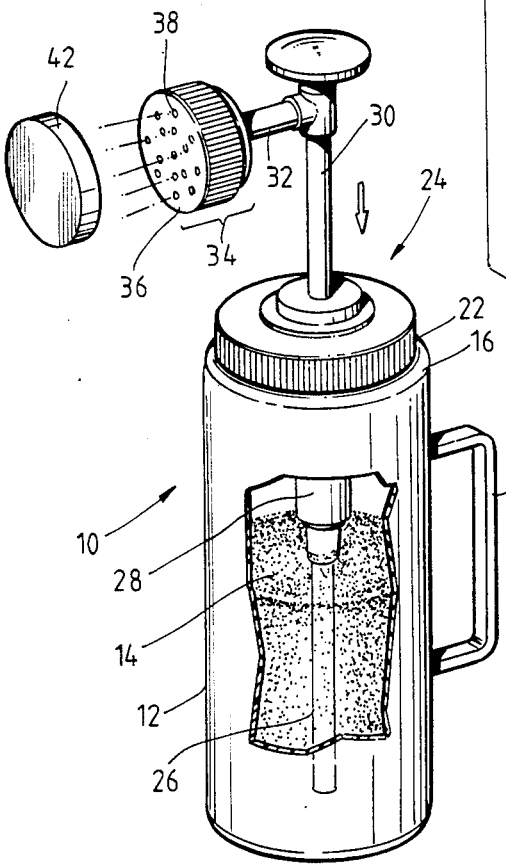
FIG. 1 is perspective view of the barbecue sauce spraying device of the present invention.
Figure 1:
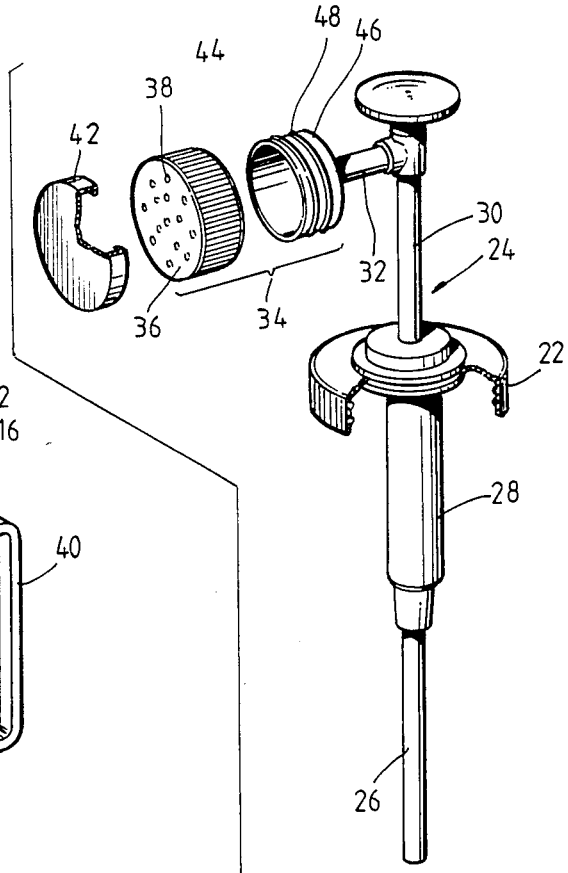
Figure 3:
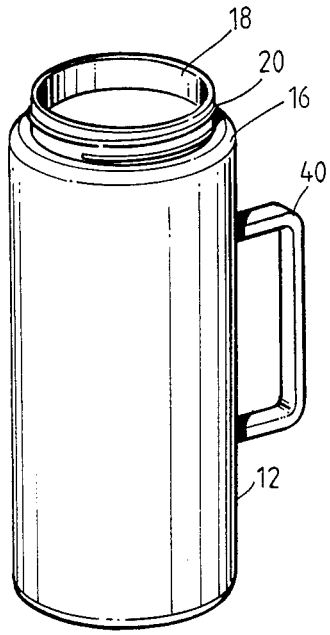
FIG. 3 is an exploded perspective view thereof.
Figure 2:
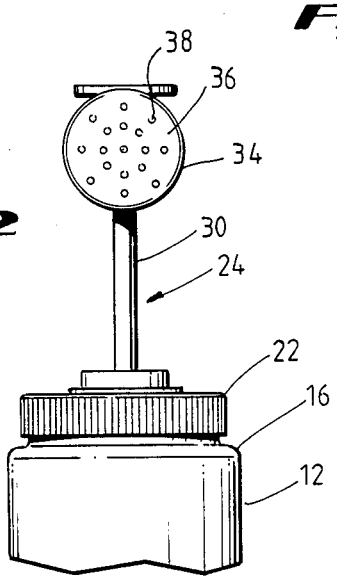
FIG. 2 is a front elevational view of the top portion of the barbecue sauce spraying device shown in FIG. 1.

As may be seen by reference to the figures the barbecue sauce spraying device 10 consists of three essential parts. The first part is a container 12 which is of sufficient size and construction to hold a predetermined amount of barbecue sauce 14. Such container may be made of glass, plastic or any suitable material which will not deteriorate in the presence of food chemicals normally found in barbecue sauce.

At the top 16 of container 12 is opening 18. Opening 18 is surrounded by threaded collar 20. Collar 20 is constructed and arranged to mount lid 22. Lid 22 is distinctive in that it provides a mounting for manual pump generally 24. Manual pump 24 includes a draw section 26, a pump section 28 and a plunger 30. Such manual pumps 24 are typically found on containers of household window washing fluid. Discharge 30 of pump 24 is connected via a fluid connection 32 to a cylindrical discharge portion 34. Cylindrical discharge portion 34 terminates in a disc 36 which has holes 38 Holes 38 are of sufficient size to allow barbecue sauce 14 to be sprayed therefrom when plunger 30 is depressed.

Cylindrical discharge portion 34 may be formed from an internally threaded cap 44 and a drum shaped receptacle 46. Cap 44 is mounted on receptacle 46 by engagement of the internal threads in cap 44 (not shown) and external threads 48 on receptacle 46.

The operation of device 10 is quite simple. All that is required is to depress plunger 30 a sufficient number of times so that barbecue sauce 14 is drawn through draw section 26, through pump section 28 and thence through connecting portion 32 into cylindrical discharge portion 34. After sufficient pressure is built up by numerous strokes of pump 24, barbecue sauce 14 will be discharged as a spray through holes 38 in disc 36 and onto the food.

For still safer operation handle 40 may be added to the side of container 12. This handle may be held by one hand while the other hand is used to depress plunger 30. Container 12, pump 24 and discharge section 30 may all be made of plastic. Such plastic should be an inert type plastic normally used for food containers. If desired, a glass container or other suitable components may be used as long as the device consists of the three essential parts described above.

If desired, a cover 42 may be used to prevent dirt and debris from entering spray holes 38 between applications of barbecue sauce. Cover 42 is sized so that it may be snapped over disc 36. While a circular disc 36 is shown in the preferred embodiment it will be understood that a variety of different shaped surfaces having holes 38 formed therein may be used in place of disc 36 without departing from the scope of the present invention.

There is now provided by the present invention a device which eliminates the hazards associated with brushing barbecue sauce 14 on food while it is being cooked over an open fire or pouring barbecue sauce on food while it is being cooked.

The barbecue sauce sprayer device of the present invention has been described in terms of the preferred embodiment; however, the invention herein is to be determined by reference to the appended claims.

I claim:

1. A device for spraying barbecue sauce comprising:

a container having a single opening surrounded by a threaded neck;

a plunger pump for pumping barbecue sauce substantially vertically out of said container, said plunger pump being mounted in a lid having a single opening, said lid constructed and arranged to threadably engage said threaded neck;

a tubular fluid connection for receiving the output of said plunger pump;

an externally threaded drum shaped receptacle for receiving the output of said tubular fluid connection;

an internally threaded cap having a plurality of holes to allow for the substantially horizontal passage of barbecue sauce, said internally threaded cap constructed and arranged to threadably engage said drum shaped receptacle.

2. The device as define in claim 1 further including a handle mounted on said container.

3. A device for spraying barbecue sauce comprising:

a container having a single open end and a threaded neck surrounding said single open end;

a manual plunger pump constructed and arranged to be mounted in a lid having a single opening which in turn is threadably mounted on said single open end of said container;

a fluid connection for receiving the substantially vertical flow of the output of said manual plunger pump;

an externally threaded drum shaped receptacle for receiving the output of said fluid connection;

a cap member having an internally threaded ring for engagement with said drum shaped receptacle and a disk having holes constructed and arranged to allow for the substantially horizontal passage of barbecue sauce.

4. The device defined in claim 3 wherein said container has a handle.

5. A method for spraying barbecue sauce comprising the steps of:

placing barbecue sauce in a container having a single opening;

pumping barbecue sauce substantially vertically from said container with a manual plunger pump;

conducting the barbecue sauce into a drum shaped receptacle;

forming a spray of the barbecue sauce by passing said barbecue sauce substantially horizontally through a disk having holes therein.

* * * * *